US009424857B2

(12) United States Patent
Sung et al.

(10) Patent No.: US 9,424,857 B2
(45) Date of Patent: Aug. 23, 2016

(54) ENCODING METHOD AND APPARATUS, AND DECODING METHOD AND APPARATUS

(75) Inventors: Jongmo Sung, Daejeon (KR); Hyun Woo Kim, Daejeon (KR); Hyun Joo Bae, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 433 days.

(21) Appl. No.: 13/638,364

(22) PCT Filed: Mar. 31, 2011

(86) PCT No.: PCT/KR2011/002227

§ 371 (c)(1),
(2), (4) Date: Sep. 28, 2012

(87) PCT Pub. No.: WO2011/122875

PCT Pub. Date: Oct. 6, 2011

(65) Prior Publication Data

US 2013/0030795 A1 Jan. 31, 2013

(30) Foreign Application Priority Data

Mar. 31, 2010 (KR) ..... 10-2010-0029302
Mar. 31, 2011 (KR) ..... 10-2011-0029340

(51) Int. Cl.
*G10L 19/02* (2013.01)
*G10L 19/00* (2013.01)
(Continued)

(52) U.S. Cl.
CPC ..... *G10L 19/0212* (2013.01); *G10L 19/0017* (2013.01); *G10L 19/24* (2013.01); *G10L 19/032* (2013.01)

(58) Field of Classification Search
CPC ..... G10L 19/24; G10L 19/032
See application file for complete search history.

(56) References Cited

U.S. PATENT DOCUMENTS 5,252,782 A 10/1993 Cantrell et al.
5,819,212 A * 10/1998 Matsumoto ..... G10L 19/0208 704/200.1

(Continued)

FOREIGN PATENT DOCUMENTS

CN 1623185 6/2005
CN 1625768 6/2005

(Continued)

OTHER PUBLICATIONS

Oshikiri, Masahiro / Ehara, Hiroyuki / Morii, Toshiyuki / Yamanashi, Tomofumi / Satoh, Kaoru / Yoshida, Koji (2007): "An 8-32 kbits scalable wideband coder extended with MDCT-based bandwidth extension on top of a 6.8 kbit/s narrowband CELP coder", In INTERSPEECH-2007, 1701-1704.*

(Continued)

*Primary Examiner* — Matthew Baker
(74) *Attorney, Agent, or Firm* — Staas & Halsey LLP

(57) ABSTRACT

An encoding method of an encoder is provided. The encoder generates first MDCT coefficients by transforming an input signal, and generates MDCT indices by quantizing the first MDCT coefficients. The encoder generates second MDCT coefficients by dequantizing the MDCT indices, and calculates MDCT residual coefficients using differences between the first MDCT coefficients and the second MDCT coefficients. The encoder generates a residual index by encoding the MDCT residual coefficients, and generates gain indices corresponding to gains from the first MDCT coefficients and the second MDCT coefficients.

34 Claims, 8 Drawing Sheets

(51) Int. Cl.
*G10L 19/24* (2013.01)
*G10L 19/032* (2013.01)

(56) References Cited

U.S. PATENT DOCUMENTS

| | | | | |
|---|---|---|---|---|
| 6,704,705 | B1 * | 3/2004 | Kabal | G10L 19/032 704/219 |
| 7,275,036 | B2 | 9/2007 | Geiger et al. | |
| 7,277,849 | B2 | 10/2007 | Streich et al. | |
| 7,548,853 | B2 | 6/2009 | Shmunck et al. | |
| 8,532,998 | B2 * | 9/2013 | Gao | G10L 21/038 704/200 |
| 2005/0060146 | A1 * | 3/2005 | Oh | G10L 21/038 704/229 |
| 2007/0033023 | A1 | 2/2007 | Sung et al. | |
| 2007/0063877 | A1 * | 3/2007 | Shmunk | G10L 19/0204 341/50 |
| 2008/0052066 | A1 * | 2/2008 | Oshikiri | G10L 21/038 704/221 |
| 2008/0140393 | A1 | 6/2008 | Kim et al. | |
| 2009/0234644 | A1 * | 9/2009 | Reznik | G10L 19/24 704/203 |
| 2009/0240491 | A1 * | 9/2009 | Reznik | G10L 19/24 704/219 |
| 2010/0070269 | A1 * | 3/2010 | Gao | G10L 19/04 704/207 |
| 2010/0169081 | A1 * | 7/2010 | Yamanashi | G10L 19/0204 704/203 |
| 2011/0295598 | A1 * | 12/2011 | Yang | G10L 21/038 704/205 |
| 2013/0339038 | A1 * | 12/2013 | Norvell | G10L 19/032 704/500 |

FOREIGN PATENT DOCUMENTS

| | | | |
|---|---|---|---|
| CN | 101527138 | 9/2009 | |
| EP | 1483759 | 9/2006 | |
| EP | 2128857 A1 | 12/2009 | |
| JP | 8-221098 | 8/1996 | |
| JP | 11-109995 | 4/1999 | |
| JP | 2005-4119 | 1/2005 | |
| KR | 1994-0006356 | 3/1994 | |
| KR | 10-2004-0105741 | 12/2004 | |
| KR | 10-2007-0012194 | 1/2007 | |
| KR | 10-2008-0025377 | 3/2008 | |
| KR | 10-0848324 | 7/2008 | |
| WO | WO2008072670 * | 6/2008 | G10L 19/02 |

OTHER PUBLICATIONS

Machine translation of WO2008072670.*

Mikko Tammi et al., "Scalable Superwideband Extension for Wideband Coding", Acoustics, Speech and Signal Processing, 2009, ICASSP 2009, IEEE, Apr. 19, 2009, pp. 161-164.

International Search Report of PCT/KR2011/002227 mailed Oct. 21, 2011.

* cited by examiner

ENCODING METHOD AND APPARATUS, AND DECODING METHOD AND APPARATUS

CROSS-REFERENCE TO RELATED APPLICATIONS

This application is a U.S. National Stage application of PCT/KR2011/002227 filed Mar. 31, 2011 and claims the foreign priority benefit of Korea Application No. 10-2010-0029302 filed Mar. 31, 2010 and Korean Application No. 10-2011-0029340 filed Mar. 31, 2011 in the Korean Intellectual Property Office, the contents of which are incorporated herein by reference.

Technical Field

The present invention relates to an encoding method and apparatus and a decoding method and apparatus, and particularly relates to encoding/decoding method and apparatus using modified discrete cosine transform (MDCT).

BACKGROUND ART

Technologies for digitally transmitting and storing speech and audio are widely used in wireless communication and a voice over IP (VoIP) service, as well as in wired communication including a conventional telephone network. If speech and audio signals are transmitted after being simply sampled and digitalized, a data rate of, for example, 64 kbps (when they are sampled at 8 kHz and each sample is encoded with 8 bits) is required. However, the speech can be transmitted in a lower data rate if a signal analysis technique and a proper coding technique are used. A waveform coding, a code-excited linear prediction (CELP) coding, and a transform coding method are widely used for speech and audio compression. The waveform coding scheme is very simple and encodes amplitude of each sample itself or a difference between each sample and a previous sample in a predetermined number of bits, but a higher bit rate is required. The CELP coding scheme is based on a speech production model, and models the speech with a linear prediction filter and an excitation signal. It can compress the speech in a relatively lower rate, but its performance on the audio signal is deteriorated. The transform coding scheme transforms time domain speech signals into frequency domain signals, and then encodes transformed coefficients corresponding to each frequency component. Typically, it can encode each frequency component using the auditory characteristics of humans.

A speech codec for the communication has evolved from narrowband coding of a conventional telephone bandwidth to wideband or super wideband coding capable of providing a better naturalness and clarity. A multi-rate codec supporting to multiple bit rates in a single codec is widely used to accommodate a variety of network environments. Furthermore, an embedded variable bit rate codec has been developed to provide bandwidth scalability for adopting signals with various bandwidths and bit-rate scalability in embedded manner. The embedded variable bit rate codec is configured such that a bit stream of a higher bit rate contains a bit stream of a lower bit rate. It usually adopts a hierarchical coding scheme. As the signal bandwidth increases, a quality of codec for audio signal such as music is also considered as an important factor. Accordingly, a hybrid coding scheme, where overall signal bandwidth is divided into two subband signals such that the waveform coding scheme or the CELP coding scheme are applied to lower band signal and the transform coding scheme is applied to higher band signal, is used. As such, the transform coding scheme is widely used in a speech codec for communication that supports the wideband or super wideband, as well as the conventional audio codec.

In the transform coding scheme, time domain signal is required to be transformed into frequency domain signal. In most of cases, the Modified Discrete Cosine Transform (MDCT) is used. The quality of transform codec suffers from quantization errors of the MDCT coefficients caused by the limited bit rate of the codec. In order to solve this problem, a method for reducing the MDCT quantization error by adding an enhancement layer with a relatively low bit rate can be used.

In this case, since the number of bits that are dynamically allocated to the MDCT coefficient depends only on an absolute value of the quantized MDCT coefficient, the overall quantization performance of the core layer and the enhancement layer is determined by the MDCT quantization performance of the core layer. However, when a large quantization error occurs in a certain MDCT coefficient and the magnitude of the quantized MDCT coefficient is less than the magnitudes of other coefficients, fewer bits are allocated to the MDCT coefficient such that the large quantization error cannot be effectively compensated.

DISCLOSURE

Technical Problem

Aspects of the present invention provide an encoding/decoding method and apparatus for effectively compensating a quantization error.

Technical Solution

According to an aspect of the present invention, an MDCT encoding method of an encoder is provided. The encoding method includes transforming an input signal to generate first modified discrete cosine transform (MDCT) coefficients by, quantizing the first MDCT coefficients to generate MDCT indices, dequantizing the MDCT indices to generate second MDCT coefficients, computing MDCT residual coefficients using differences between the first MDCT coefficients and the second MDCT coefficients, encoding the MDCT residual coefficients to generate a residual index by, and generating gain indices corresponding to gains of the first MDCT coefficients from the first MDCT coefficients and the second MDCT coefficients.

The encoding method may further include multiplex the MDCT indices, the residual index, and the gain indices to generate a bit stream.

Generating the residual index may include selecting an index of a sub-band with a largest energy of MDCT residual coefficients among a plurality of sub-bands, and generating a sub-band index by encoding the selected index. The residual index may include the sub-band index.

The energy of the MDCT residual coefficient of a j-th sub-band may be computed as $$\sum_{k=l_j}^{u_j} \{E(k)\}^2.$$

Here, $u_j$ and $l_j$ are a lower boundary index and an upper boundary index of the j-th sub-band, respectively, and E(k) is a k-th MDCT residual coefficient.

Generating the residual index may further include encoding MDCT residual coefficients of the selected sub-band.

Encoding the MDCT residual coefficients may further include configuring a plurality of tracks for MDCT residual coefficients of the selected sub-band, selecting a pulse corresponding to a predetermined number of MDCT residual coefficients having a largest absolute value, among MDCT residual coefficients corresponding to possible positions in each track, and coding the pulse. The residual index may further include a coded value of the pulse.

Coding the pulse may include coding a position of the pulse, coding the sign of the pulse, and coding the amplitude of the pulse. The coded value of the pulse may include a coded value of the position, a coded value of the sign, and a coded value of the amplitude.

The position may be a position that is relative to a lower boundary index of the selected sub-band.

Encoding the MDCT residual coefficients may include computing a root mean square (RMS) value of the MDCT residual coefficients of the selected sub-band, and quantizing the RMS value to generate an RMS index. The residual index may further include the RMS index.

Encoding the amplitude of the pulse may include dequantizing the RMS index to generate a quantized RMS value, and coding the amplitude of the pulse using the amplitude of the pulse divided by the quantized RMS value.

Generating the gain indices may include computing exponents as logarithms of magnitudes of the second MDCT coefficients at positions excluding the position of the pulse, setting an exponent to a minimum exponent magnitude at the position of the pulse, and allocating bits for the gain indices based on the exponents.

Generating the gain indices may further include determining the gain indices from the allocated bits, the first MDCT coefficients, and the second MDCT coefficients.

The gain index may be determined as i for maximizing $-2\cdot g_i^m\cdot X(k)\cdot\hat{X}(k)+(g_i^m)^2\cdot(\hat{X}(k))$. Here, $g_i^m$ is an i-th codeword of a codebook corresponding to m bits, i is an integer within a range of 0 to $(2^m-1)$, X(k) is a k-th first MDCT residual coefficient, and $\hat{X}(k)$ is a k-th second MDCT residual coefficient.

According to another aspect of the present invention, an MDCT decoding method of a decoder is provided. The decoding method includes receiving MDCT indices, a residual index, and gain indices, dequantizing the MDCT indices to generate first MDCT coefficients, decoding the residual index to recover MDCT residual coefficients, recovering gains from the gain indices using a position of a pulse corresponding to the MDCT residual coefficients and the first MDCT coefficients, compensating gains of the first MDCT coefficients with the recovered gains to generate second MDCT coefficients, and compensating residuals of the second MDCT coefficients with the MDCT residual coefficients.

Compensating the residuals may include adding the MDCT residual coefficients to the second MDCT coefficients.

The MDCT residual coefficients may have a value of 0 at positions excluding the position of the pulse.

The residual index may include a sub-band index, and recovering the MDCT residual coefficients may include determining a sub-band of the MDCT residual coefficients by decoding the sub-band index.

The residual index may include a coded value of the position of the pulse, a coded value of the sign of the pulse, and a coded value of the amplitude of the pulse.

Recovering the MDCT residual coefficients may include decoding the coded value of the amplitude of the pulse to recover the amplitude of the pulse, decoding the coded value of the position of the pulse to recover the position of the pulse, decoding the coded value of the sign of the pulse to recover the sign of the pulse, and recovering the MDCT residual coefficients based on the position, sign, and amplitude of the pulse.

The residual index may further include a root mean square (RMS) index. Recovering the amplitude of the pulse may include generating a quantized RMS value from the RMS index, and multiplying the decoded amplitude of the pulse by the quantized RMS value to recover the amplitude of the pulse.

Recovering the gains may include computing exponents as logarithms of magnitudes of the first MDCT coefficients at positions excluding the position of the pulse, setting an exponent to a minimum exponent magnitude at the position of the pulse, and generating a bit allocation table by allocating bits to the gain indices based on the exponents.

Recovering the gains may further include recovering the gains from the gain indices using the bit allocation table.

The decoding method may further include recovering a signal by transforming MDCT coefficients, which are generated by compensating the residuals of the second MDCT coefficients, by an inverse MDCT.

According to yet another aspect of the present invention, an MDCT encoding apparatus including an MDCT, an MDCT quantizer, an enhancement layer encoder, and a multiplexer is provided. The MDCT transforms an input signal to generate first MDCT coefficients, and the MDCT quantizer quantizes the first MDCT coefficients to generate MDCT indices. The enhancement layer encoder dequantizes the MDCT indices to generate second MDCT coefficients, encoding MDCT residual coefficients corresponding to differences between the first MDCT coefficients and the second MDCT coefficients to generate a residual index, and generates gain indices corresponding to gains of the first MDCT coefficients from the first MDCT coefficients and the second MDCT coefficients. The multiplexer multiplexes the MDCT indices, the residual index, and the gain indices to generate a bit stream.

According to a further aspect of the present invention, an MDCT decoding apparatus including a demultiplexer, an MDCT dequantizer, and an enhancement layer decoder is provided. The demultiplexer demultiplexes a received bit stream to output MDCT indices, a residual index, and gain indices, and the MDCT dequantizer dequantizes the MDCT indices to generate first MDCT coefficients. The enhancement layer decoder decodes the residual index to recover MDCT residual coefficients, recovers gains from the gain indices using a position of a pulse corresponding to the MDCT residual coefficients and the first MDCT coefficients, compensates gains of the first MDCT coefficients with the recovered gains to generate second MDCT coefficients, and compensates residuals of the second MDCT coefficients with the MDCT residual coefficients.

Advantageous Effects

According to the embodiment of the present invention, a combination of gain compensation scheme and residual compensation scheme can mitigate degradation of sound quality which may be resulted from a spectrum distortion caused by inconsistency between bit allocation in the gain compensation scheme and actual errors.

MODE FOR INVENTION

Figure 1:
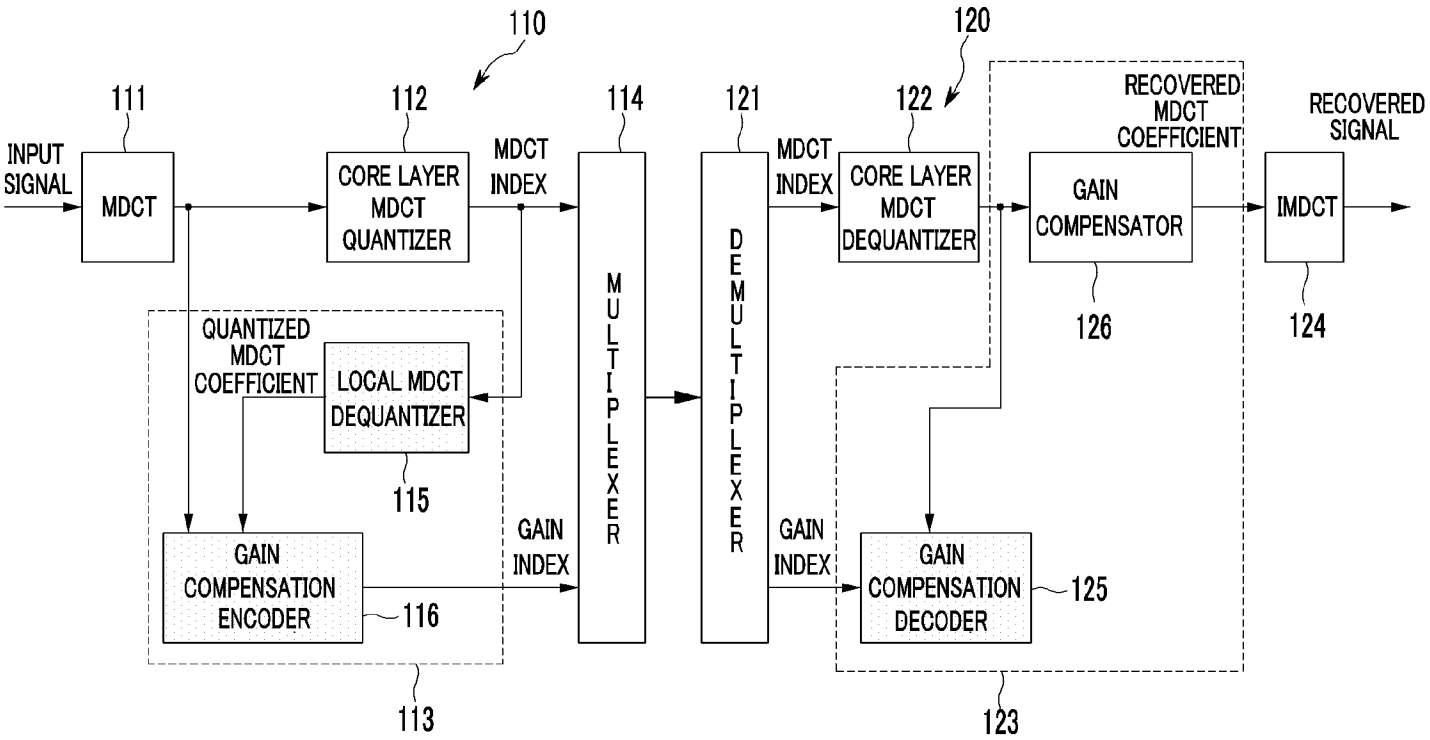
FIG. 1 is a block diagram showing one example of a hierarchical MDCT quantization system.

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Figure 2:
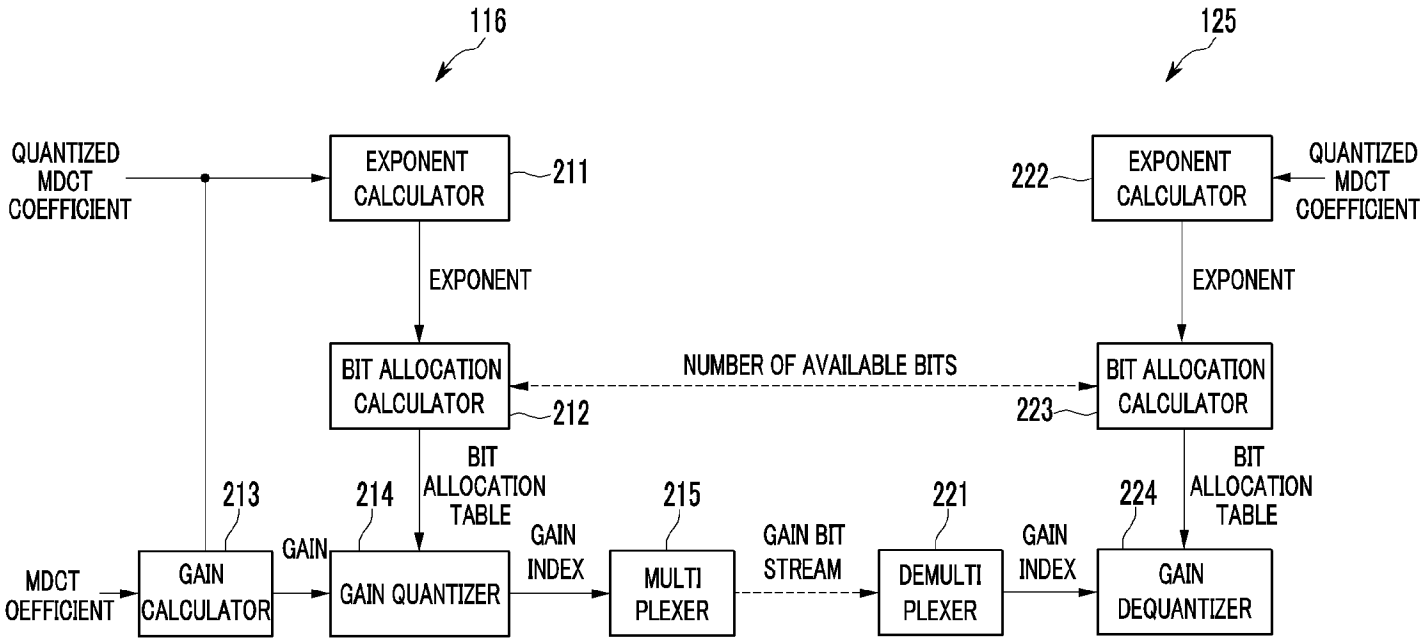
FIG. 2 is a block diagram showing a gain compensation encoder and a gain compensation decoder shown in FIG. 1.
Figure 3:
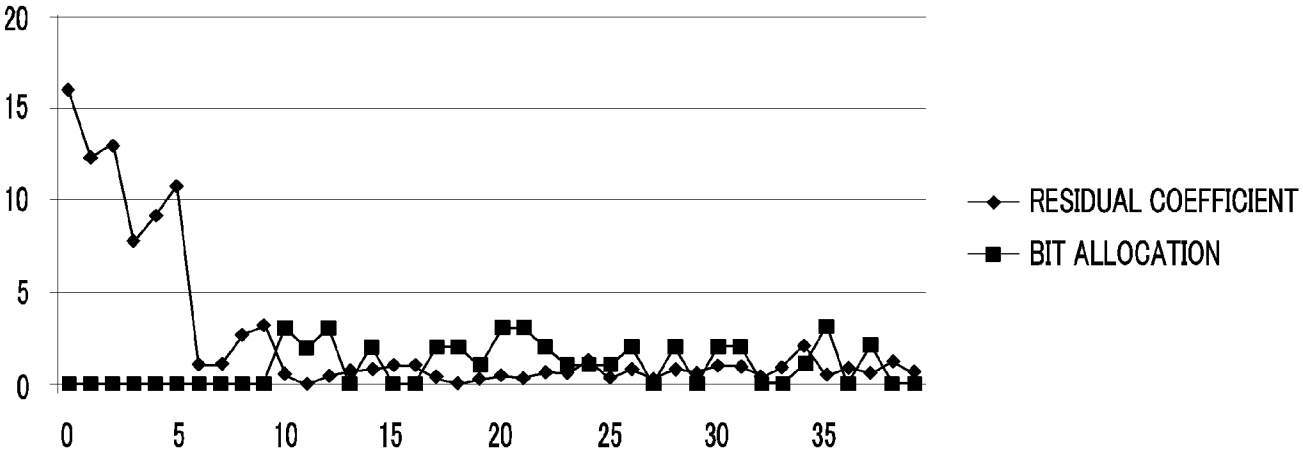
FIG. 3 is a drawing showing performance of the MDCT quantization system shown in FIG. 1.

FIG. 1 is a block diagram showing one example of a hierarchical MDCT quantization system, FIG. 2 is a block diagram showing a gain compensation encoder and a gain compensation decoder shown in FIG. 1, and FIG. 3 is a drawing showing performance of the MDCT quantization system shown in FIG. 1.

Referring to FIG. 1, the hierarchical MDCT quantization system includes an encoder 110 for encoding input signal to generate a bit stream, and a decoder 120 for decoding the bit stream to generate a reconstructed signal.

The encoder 110 includes an MDCT 111, a core layer MDCT quantizer 112, an enhancement layer encoder 113, and a multiplexer 114. The enhancement layer encoder 113 includes a local MDCT dequantizer 115 and a gain compensation encoder 116.

The MDCT 111 transforms the input signal into MDCT coefficients as in Equation 1.

$$X(k) = \sum_{n=0}^{2N-1} w(n)x(n)\cos\left(\frac{\pi}{N}\left(n+\frac{1}{2}+\frac{N}{2}\right)\left(k+\frac{1}{2}\right)\right), \quad k = 0, 1, \ldots, (N-1) \qquad \text{(Equation 1)}$$

where, N is a number of samples in a frame corresponding to processing unit of time domain input signal in a block-by-block basis, w(n) is a window function, x(n) is the input signal, X(k) is the MDCT coefficient, n is a time domain index, and k is a frequency domain index.

The core layer MDCT quantizer 112 quantizes the MDCT coefficients to generate quantized MDCT indices. The core layer MDCT quantizer 112 may use various traditional quantization schemes such as the shape-gain vector quantization (VQ), the lattice VQ, the spherical VQ, and the algebraic VQ etc.

The local MDCT dequantizer 115 outputs quantized MDCT coefficients from the MDCT indices by dequantization. The gain compensation encoder 116 calculates gains between unquantized MDCT coefficients and the quantized MDCT coefficients, and quantizes the gains to generate gain indices.

The multiplexer 114 multiplexes the MDCT indices and the gain indices to output the bit stream.

The decoder 120 includes a demultiplexer 121, a core layer MDCT dequantizer 122, an enhancement layer decoder 123, and an inverse MDCT (IMDCT) 124. The enhancement layer decoder 123 includes a gain compensation decoder 125 and a gain compensator 126.

The demultiplexer 121 demultiplexes the received bit stream to output the MDCT indices and the gain indices.

The core layer MDCT dequantizer 122 outputs quantized MDCT coefficients from the MDCT indices by dequantization.

The gain compensation decoder 125 decodes the gain indices to output quantized gains. The gain compensator 126 scales the quantized MDCT coefficients by the quantized gains to output gain-compensated MDCT coefficients. The gain-compensated MDCT coefficients can be obtained as in Equation 2.

$$\hat{X}_{gc}(k)=\hat{g}(k)\cdot\hat{X}(k),\ k=0,1,\ldots,(N-1) \qquad \text{(Equation 2)}$$

where, $\hat{X}(k)$ and $\hat{X}_{gc}(k)$ are the quantized MDCT coefficients and the gain-compensated MDCT coefficients, respectively, and $\hat{g}(k)$ is the quantized gain.

The IMDCT 124 inversely transforms the gain-compensated MDCT coefficients into intermediate signal in time domain as expressed in Equation 3.

$$y(n) = \frac{1}{N}\sum_{n=0}^{N-1} \hat{X}_{gc}(k)\cos\left(\frac{\pi}{N}\left(n+\frac{1}{2}+\frac{N}{2}\right)\left(k+\frac{1}{2}\right)\right) \qquad \text{(Equation 3)}$$

$$n = 0, 1, \ldots, (2N-1)$$

$$\hat{x}(n) = y'(n+N) + y(n),$$

$$n = 0, 1, \ldots, (N-1)$$

where, y(n) is the inverse-transformed time domain signal in a current frame, y'(n) is the inverse-transformed time domain signal in a previous frame, and $\hat{x}(n)$ is the reconstructed signal.

Referring to FIG. 2, the gain compensation encoder 116 includes an exponent calculator 211, a bit allocation calculator 212, a gain calculator 213, a gain quantizer 214, and a multiplexer 215. The exponent calculator 211 calculates an exponent by dividing an absolute value of each quantized MDCT coefficient by a predetermined step. For example, assuming that the step is set to a logarithmic unit with a base of 2, the exponent calculator 211 may calculate the exponent as the logarithm of the quantized MDCT coefficient. Accordingly, the calculated exponent is exponentially proportional to the absolute value of the quantized MDCT coefficient.

$$\text{MIN_EXP} \le \exp[k] = \lfloor \log_2(|\hat{X}(k)|) \rfloor \le \text{MAX_EXP},\ k=0, 1, \ldots, (N-1) \qquad \text{(Equation 4)}$$

where, $|\cdot|$ is an absolute value operation, $\lfloor\cdot\rfloor$ is a rounding operation, and MIN_EXP and MAX_EXP are a minimum and a maximum exponent magnitude, respectively.

The bit allocation calculator 212 dynamically calculates the number of bits for gain quantization of each MDCT coefficient, using exponent of all the MDCT coefficients in a frame and the predetermined number of available bits, thereby outputting a bit allocation table. Here, the bit allocation table stores the number of bits allocated to compensate gain of each MDCT coefficient within the available bit budget. The bit allocation calculator 212 may restrict the minimum and the maximum number of gain bits allowable for each MDCT coefficient, as in Equation 5.

$$\text{MIN_BITS} \le b(k) \le \text{MAX_BITS} \qquad \text{(Equation 5)}$$

$$B_{enh} = \sum_{k=0}^{N-1} b(k)$$

where, b(k) is the number of gain bits allocated to the k-th MDCT coefficient. MIN_BITS and MAX_BITS are the minimum and the maximum number of gain bits, respectively. $B_{enh}$ is the total number of bits allocated to the enhancement layer.

The gain calculator 213 calculates a gain between the unquantized MDCT coefficient and the quantized MDCT coefficient, and outputs the gain for each MDCT coefficient. The gain calculator 213 may calculate the gain for minimizing error as in Equation 6.

$$\begin{aligned} Err(k) &= \left(X(k) - g(k)\cdot\hat{X}(k)\right)^2,\ k = 0, 1, \ldots, (N-1) \qquad \text{(Equation 6)} \\ &= (X(k))^2 - 2g(k)\cdot X(k)\cdot\hat{X}(k) + \\ &\quad (g(k))^2\cdot\left(\hat{X}(k)\right)^2 \end{aligned}$$

where, Err(k) is the error for k-th MDCT coefficient, and g(k) is the gain for k-th MDCT coefficient.

The gain quantizer 214 quantizes the gains using the number of quantized bits corresponding to each MDCT coefficient in the bit allocation table, and outputs gain indices. When a gain quantization codebook is used for the gain quantization, the gain calculator 213 and the gain quantizer 214 may determine the gain indices by searching the gain quantization codebook using the unquantized MDCT coefficient and the quantized MDCT coefficient. The gain index may be given as in Equation 7.

$$I_{opt}(k) = \underset{\{g_i^m \in C_g^m | i=0,\ldots,(2^m-1)\}}{\operatorname{argmax}} \left\{-2\cdot g_i^m\cdot X(k)\cdot\hat{X}(k) + (g_i^m)^2\cdot\left(\hat{X}(k)\right)\right\} \qquad \text{(Equation 7)}$$

where, $C_g^m$ is a codebook corresponding to m bits and has $2^m$ codewords. $g_i^m$ is the i-th codeword of the m-bit codebook, and $I_{opt}(k)$ is the best gain index corresponding to the k-th MDCT coefficient.

The multiplexer 215 multiplexes the gain index for each MDCT coefficient to output a gain bit stream.

The gain compensation decoder 125 includes a demultiplexer 221, an exponent calculator 222, a bit allocation calculator 223, and a gain dequantizer 224.

The exponent calculator 222 and the bit allocation calculator 223 perform the same operations as the exponent calculator 211 and the bit allocation calculator 212 of the gain correction encoder 116. The demultiplexer 221 demultiplexes the gain bit stream to extract the gain indices for the MDCT coefficients referring to the bit allocation table. The gain dequantizer 224 recovers the quantized gain for each MDCT coefficient using each gain index and the bit allocation table.

A gain compensation method of frequency domain coefficients, specifically MDCT coefficients described with reference to FIG. 1 and FIG. 2 can provide relatively simple and excellent performance. However, since the number of bits that are dynamically allocated to each MDCT coefficient depends only on the absolute value of the quantized MDCT coefficient, the overall quantization performance of the combination of core layer and enhancement layer may be deteriorated if the performance of the core layer MDCT quantizer 112 is poor. That is, when the core layer MDCT quantizer results in a large quantization error in a certain MDCT coefficient and the magnitude of the quantized MDCT coefficient is less than the magnitude of other coefficients, a dynamic bit allocator may allocate fewer bits to the MDCT coefficient. As a result, the large quantization error of the core layer cannot be effectively compensated.

Referring to FIG. 3, a bit allocation table and magnitudes of MDCT residual coefficients, which are calculated by performing a method of FIG. 1 and FIG. 2 on a input speech frame, are illustrated. In FIG. 3, a frame length N is 40, and the minimum and the maximum number of bits per MDCT coefficient are 0 and 3, respectively. In this case, even though the magnitudes of the first six MDCT residual coefficients are significantly greater than the remaining residual coefficients, it can be noted that no bits are allocated to the first six MDCT residual coefficients.

Hereinafter, a quantization method and apparatus of frequency domain coefficients to mitigate inconsistency between the bit allocation table and the MDCT residual coefficient will be described.

Figure 4:
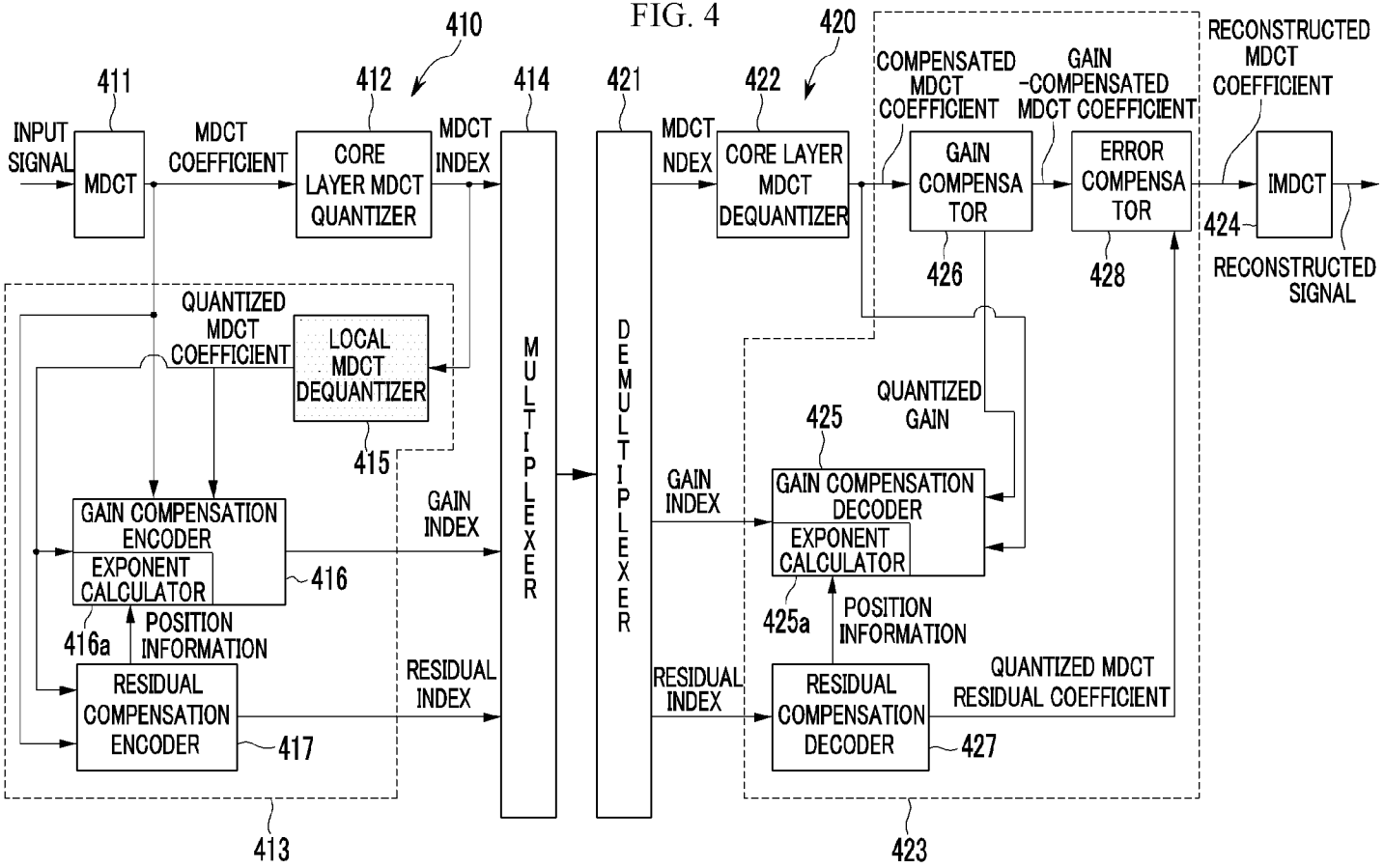
FIG. 4 is a block diagram of a hierarchical MDCT quantization system according to an embodiment of the present invention.

FIG. 4 is a block diagram of a hierarchical MDCT quantization system according to an embodiment of the present invention.

Referring to FIG. 4, the hierarchical MDCT quantization system includes a speech and audio encoder 410 and a decoder 420 that use a hierarchical MDCT quantization scheme.

The encoder 410 includes an MDCT 411, a core layer MDCT quantizer 412, an enhancement layer encoder 413, and a multiplexer 414. The enhancement layer encoder 413 includes a local MDCT dequantizer 415, a gain compensation encoder 416, and a residual compensation encoder 417.

The MDCT 411 transforms an input signal into MDCT coefficients by the MDCT. Here, the input signal is a full band speech and/or audio signal with a whole band, a signal with only a part of whole band at a split band codec, or a residual signal of a scalable codec. The core layer MDCT quantizer 412 quantizes the MDCT coefficients to output MDCT indices. The local MDCT dequantizer 415 outputs quantized MDCT coefficients from the MDCT indices by dequantization. The MDCT 411, the core layer MDCT quantizer 412, and the local MDCT dequantizer 415 may operate in the same way as the MDCT 111, the core layer MDCT quantizer 112, and the local MDCT dequantizer 115 described in FIG. 1.

As expressed in Equation 8, the total number of bits allocated to the enhancement layer is divided into two parts, which are allocated to gain compensation encoding of the gain compensation encoder 416 and residual compensation encoding of the residual compensation encoder 417.

$$B_{enh} = B_{gc} + B_{ec} \qquad \text{(Equation 8)}$$

Here, $B_{enh}$ is the entire number of bits allocated to the enhancement layer, and $B_{gc}$ and $B_{ec}$ are the number of bits allocated to the gain compensation encoder 416 and the number of bits allocated to the residual compensation encoder 417, respectively. The number of bits $B_{enh}$ allocated to the enhancement layer may be equal to the number of available bits of FIG. 2.

The residual compensation encoder 417 calculates MDCT residual coefficients from the unquantized MDCT coefficients and the quantized MDCT coefficients. For example, the MDCT residual coefficients are computed by subtracting the quantized MDCT coefficient from the unquantized MDCT coefficient and. The residual compensation encoder 417 selects a predetermined number of MDCT residual coefficients among the entire MDCT residual coefficients, and quantizes the selected MDCT residual coefficients to output residual indices. Further, the residual compensation encoder 417 transfers position information of the selected MDCT residual coefficients, i.e., pulse position information, to an exponent calculator 416*a* of the gain compensation encoder 416.

The gain compensation encoder 416 calculates gains based on unquantized MDCT coefficients, the quantized MDCT coefficients, and the pulse position information, and then quantizes each gain to output a gain index. The exponent calculator 416*a* of the gain compensation encoder 416 sets exponents of the MDCT coefficients corresponding to the pulse position information from the residual compensation encoder 417 to a minimum value of MIN_EXP, and calculates exponents of the remaining MDCT coefficients as described with reference to FIG. 1 and FIG. 2. The gain compensation encoder 416 may calculate the exponents by changing the number of available bits from $B_{enh}$ to $B_{gc}$ in the exponent calculating procedure of the exponent calculator 211 shown in FIG. 2.

The multiplexer 414 multiplexes the MDCT indices, the gain indices, and the residual indices to output a bit stream.

The decoder 420 includes a demultiplexer 421, a core layer MDCT dequantizer 422, an enhancement layer decoder 423, and an IMDCT 424. The enhancement layer decoder 423 includes a gain compensation decoder 425, a gain compensator 426, a residual compensation decoder 427, and an error compensator 428.

The demultiplexer 421 demultiplexes the received bit stream to output the MDCT indices, the gain indices, and the residual indices.

The core layer MDCT dequantizer 422 dequantizes the MDCT indices to output the quantized MDCT coefficients. The gain compensator 426 scales the quantized MDCT coefficients by the quantized gains to output gain-compensated MDCT coefficients. The IMDCT 424 inversely transforms the reconstructed MDCT coefficients to a reconstructed signal. The core layer MDCT dequantizer 422, the gain compensator 426, and the IMDCT 424 may operate in the same way as the core layer MDCT dequantizer 122, the gain compensator 126, and the IMDCT 124 described with reference to FIG. 1.

The residual compensation decoder 427 decodes the residual indices to output the quantized MDCT residual coefficients, and transfers the pulse position information of the selected MDCT residual coefficients to an exponent calculator 425*a* of the gain compensation decoder 425.

The gain compensation decoder 425 decodes the gain indices based on the quantized MDCT coefficients and the pulse position information to output the quantized gains. The exponent calculator 425*a* of the gain compensation decoder 425 sets exponents of the MDCT coefficients corresponding to the pulse position transferred from the residual compensation decoder 427 to the minimum value of MIN_EXP, and calculates the exponents of the remaining MDCT coefficients as described with reference to FIG. 1 and FIG. 2. The gain compensation decoder 425 may calculate the exponents by changing the number of available bits from $B_{enh}$ to $B_{gc}$ in the exponent calculating procedure of the exponent calculator 222 shown in FIG. 2. Since the exponent of the MDCT coefficients at the selected pulse positions is set to the minimum value, the quantized gain for these MDCT coefficients can be set to 1. That is, the gain-compensated MDCT coefficients by the gain compensator 426 at the selected pulse positions can be substantially equal to the quantized MDCT coefficients.

The residual compensator 428 compensates the gain-compensated MDCT coefficients to output the reconstructed MDCT coefficients. The reconstructed MDCT coefficients may be calculated as expressed in Equation 9.

$$\hat{X}^{c}(k)=\hat{X}_{gc}(k)+\hat{E}(k),\ k=0,1,\ldots,(N-1) \quad \text{(Equation 9)}$$

Here, $\hat{X}_{gc}(k)$ is the gain-compensated MDCT coefficient, $\hat{E}(k)$ is the quantized MDCT residual coefficient, and $\hat{X}_{c}(k)$ is the reconstructed MDCT coefficient. Since the residual indices are generated at only the selected pulse positions in the encoder side, the quantized MDCT residual coefficients have a value of 0 at positions excluding the selected pulse positions.

As such, the hierarchical MDCT quantization system according to the embodiment of the present invention can recover the MDCT coefficient at the selected position using the MDCT residual coefficient, and recover the MDCT coefficient using the quantized gain at the position excluding the selected position. That is, the hierarchical MDCT quantization system according to the embodiment of the present invention can perform both the residual compensation and the gain compensation, thereby effectively quantizing the MDCT coefficients.

Figure 5:
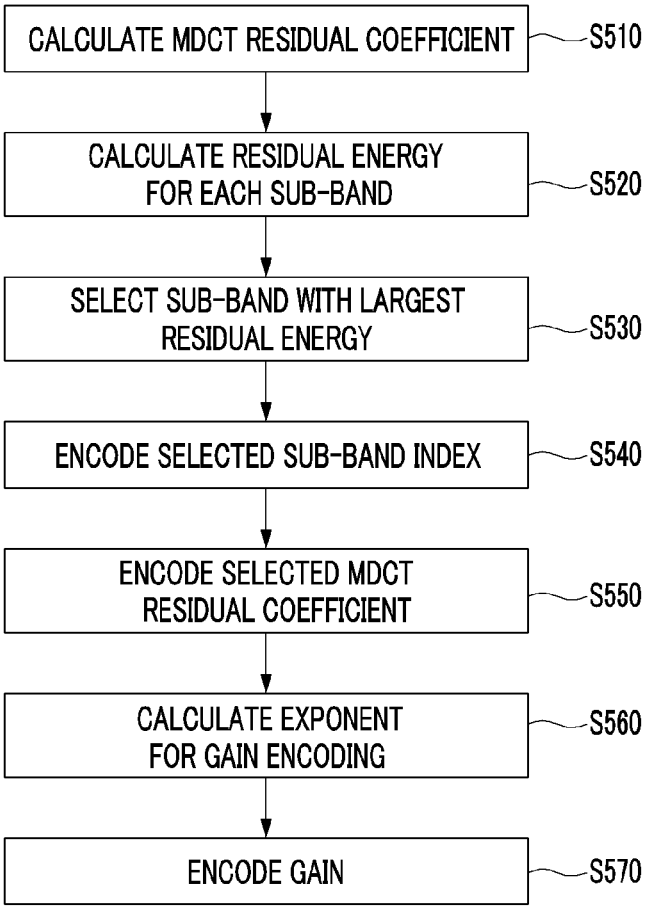
FIG. 5 is a flowchart of an MDCT enhancement layer encoding method according to an embodiment of the present invention.

FIG. 5 is a flowchart of an MDCT enhancement layer encoding method according to an embodiment of the present invention.

Referring to FIG. 5, an encoder 410 computes MDCT residual coefficients from quantized MDCT coefficients and MDCT coefficients (S510). The MDCT residual coefficients E(k) may be calculated as in Equation 10.

$$E(k)=X(k)-\hat{X}(k),\ k=0,1,\ldots,(N-1) \quad \text{(Equation 10)}$$

The encoder 410 computes the residual energy of each sub-band using the computed MDCT residual coefficients (S520). The number of sub-bands and boundaries of each sub-band may be specified in a codec design procedure. The residual energy of each sub-band may be calculated as in Equation 11.

$$e(j)=\sum_{k=l_j}^{u_j}\{E(k)\}^2,\ j=0,1,\ldots,(M-1) \quad \text{(Equation 11)}$$

where, e(j) is the residual energy of the j-th sub-band, M is the number of sub-bands, and $l_j$ and $u_j$ are lower and upper boundary index of the j-th sub-band, respectively.

The encoder 410 selects sub-band index with the largest residual energy, $j_{max}$ among all sub-bands as in Equation 12 (S530).

$$j_{max}=\underset{all\ j}{\operatorname{argmax}}\{e(j)\} \quad \text{(Equation 12)}$$

The encoder 410 encodes selected sub-band index $j_{max}$ (S540). For example, when the number of sub-bands is 4, the sub-band index may be coded in 2 bits. And then, the encoder 410 encodes the MDCT residual coefficients of the selected sub-band (S550). A root mean square (RMS) value for the MDCT residual coefficients in the selected sub-band may be computed and then quantized to generate an RMS index. Then, the quantized RMS value is obtained from the RMS index by the dequantization. The MDCT residual coefficients of the selected sub-band are partitioned into T tracks, and MDCT residual coefficient(s) with the $N_p^t$ largest absolute value(s) in each track are selected. $N_p^t$ is the number of selected pulse(s) of the t-th track. The selected MDCT residual coefficient of each track, i.e., the pulse, is coded in its position, sign, and amplitude, respectively.

The selected sub-band index, the position, sign, and amplitude of each pulse in the selected sub-band, and the RMS index are combined as the residual index.

Next, for the gain compensation encoding, the encoder 410 calculates exponents based on position information of the MDCT residual coefficient of each track and the quantized MDCT coefficients (S560). The exponents may be calculated as in Equation 13. Since the selected pulses are already coded as the residual index, the encoder 410 sets the exponent of the selected pulses to the minimum exponent value, thereby preventing a waste of bit allocation.

$$\exp(p_i+l_{j_{max}})=\text{MIN_EXP},\ i=0,1,\ldots,(N_p-1) \qquad \text{(Equation 13)}$$

$$\exp[k]=(\text{MIN_EXP}\le\lfloor \log_2(|\hat{X}(k)|)\rfloor\le\text{MAX_EXP}),\quad k\ne p_i+l_{j_{max}},\ i=0,1,\ldots,(N_p-1)$$

where, $p_i$ is a position of the i-th pulse which is relative to the lower boundary index $l_{j_{max}}$ of the selected sub-band, and $N_p$ is the total number of pulses, which may be given in Equation 14.

$$N_p=\sum_{t=0}^{T-1}N_p^t \qquad \text{(Equation 14)}$$

The encoder 410 outputs gain indices by performing the gain encoding process, as described in the gain compensation encoder 116 of FIG. 2 (S570). As described above, the number of available bits for gain compensation is $B_{gc}$.

Figure 6:
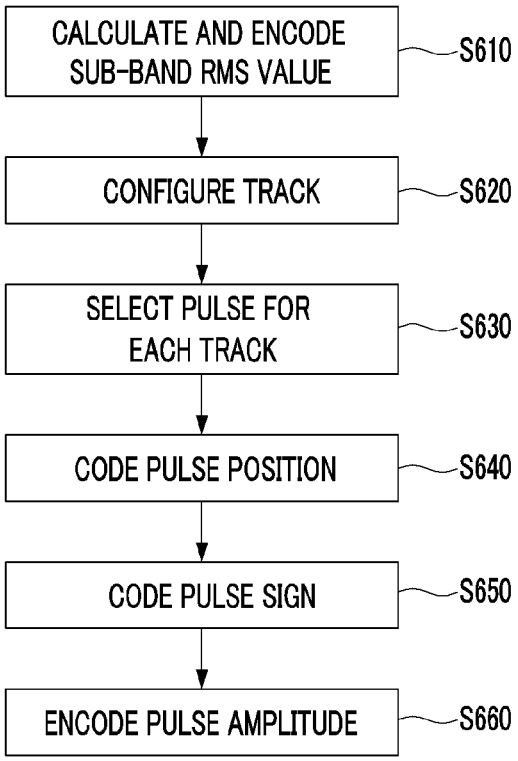
FIG. 6 is a flowchart showing a sub-band MDCT residual coefficients encoding process in an MDCT enhancement layer encoding method according to an embodiment of the present invention.

FIG. 6 is a flowchart showing a sub-band MDCT residual coefficient encoding process in an MDCT enhancement layer encoding method according to an embodiment of the present invention.

The error compensation encoder 417 of the encoder 410 calculates a RMS value for the MDCT residual coefficients of the sub-band selected in the step S530, and quantizes the RMS value to output the RMS index (S610). The RMS value (rms) may be calculated as in Equation 15, and may be logarithmically quantized to the RMS index, $I_{rms}$ as in Equation 16.

$$N_{sb}^{j_{max}}=u_{j_{max}}-l_{j_{max}}+1 \qquad \text{(Equation 15)}$$

$$\text{rms}=\sqrt{\frac{1}{N_{sb}^{j_{max}}}\cdot e(j_{max})}$$

where, $N_{sb}^{j_{max}}$ is the number of MDCT residual coefficients of the $j_{max}$-th sub-band.

$$I_{rms}=\text{round}(\log_2 \text{rms}) \qquad \text{(Equation 16)}$$

The residual compensation encoder 417 configures tracks for sub-band MDCT residual coefficients to find the pulses (S620). For example, when the number of MDCT residual coefficients of the selected sub-band is 12 and the number of possible positions of each track is 4, the tracks may be configured as in Table 1 or Table 2 depending on the interleaving. Table 1 shows the track structure when the interleaving is not applied and Table 2 shows the track structure when the interleaving is applied.

TABLE 1

| Track | Position |
|---|---|
| 0 | 0, 1, 2, 3 |
| 1 | 4, 5, 6, 7 |
| 2 | 8, 9, 10, 11 |

TABLE 2

| Track | Position |
|---|---|
| 0 | 0, 3, 6, 9 |
| 1 | 1, 4, 7, 10 |
| 2 | 2, 5, 8, 11 |

where, the positions in Table 1 and 2 are relative to the lower boundary of the selected subband, $l_{j_{max}}$.

The residual compensation encoder 417 selects the predetermined number of pulses in each track using the tracks (S630). For example, if the number of pulses per track is 1, the residual compensation encoder 417 searches one MDCT residual coefficient having the largest absolute value among MDCT residual coefficients of each track.

The residual correction encoder 417 divides each pulse searched in the step S630 into its position, sign, and amplitude components, which are quantized respectively. The pulse position is coded as to a relative to starting position of each track (S640). In the examples of Table 1 and Table 2, the position of the searched pulse can be encoded with 2 bits since the number of possible positions in each track is 4. The sign of the searched pulse can be coded with 1 bit (S650), and the pulse amplitude i.e., an absolute value of each searched pulse can be quantized (S660). For example, after reconstructing the quantized RMS value from the RMS index of the step S610 by the dequantization, the pulse amplitudes may be normalized with the quantized RMS value and then may be encoded to the coded value $I_{amp}$ using scalar quantization or vector quantization.

$$\overline{m}(i)=\frac{|E(p_i)|}{\text{rms_q}},\ i=0,1,\ldots,(N_p-1) \qquad \text{(Equation 17)}$$

where, $\overline{m}(i)$ is the RMS-normalized pulse amplitude of the i-th pulse, and rms_q is the quantized RMS value.

If only one MDCT residual coefficient with the largest absolute valueper track is selected, i.e., $N_p^t$ is 1, the coded value of the pulse position $I_{pos}(t)$ and the coded value of the pulse sign $I_{sign}(t)$ may be expressed as in Equations 18 and 19, respectively.

$$I_{pos}(t)=\frac{p(t)-t}{3},\ t=0,1,2 \qquad \text{(Equation 18)}$$

where, t is an index of the track, and p(t) is the selected pulse position in the t-th track and corresponds to $p_i$ in Equation 13.

$$I_{sign}(t) = \frac{s(t)+1}{2},\ t = 0, 1, 2 \quad \text{(Equation 19)}$$

where, s(t) is the selected pulse sign in the t-th track and may be expressed as in Equation 20.

$$s(t) = \begin{cases} +1, & \text{if } E(p(t)) \geq 0 \\ -1, & \text{otherwise} \end{cases} \quad \text{(Equation 20)}$$

The MDCT indices, the gain indices, and the residual indices are multiplexed to a bit stream as expressed in Table 3.

TABLE 3

| $I_{rms}$ | $I_{pos}$ (0) | $I_{sign}$ (0) | $I_{pos}$ (1) | $I_{sign}$ (1) | $I_{pos}$ (2) | $I_{sign}$ (2) | $I_{amp}$ | $I_{opt}$ (k) |
|---|---|---|---|---|---|---|---|---|

Figure 7:
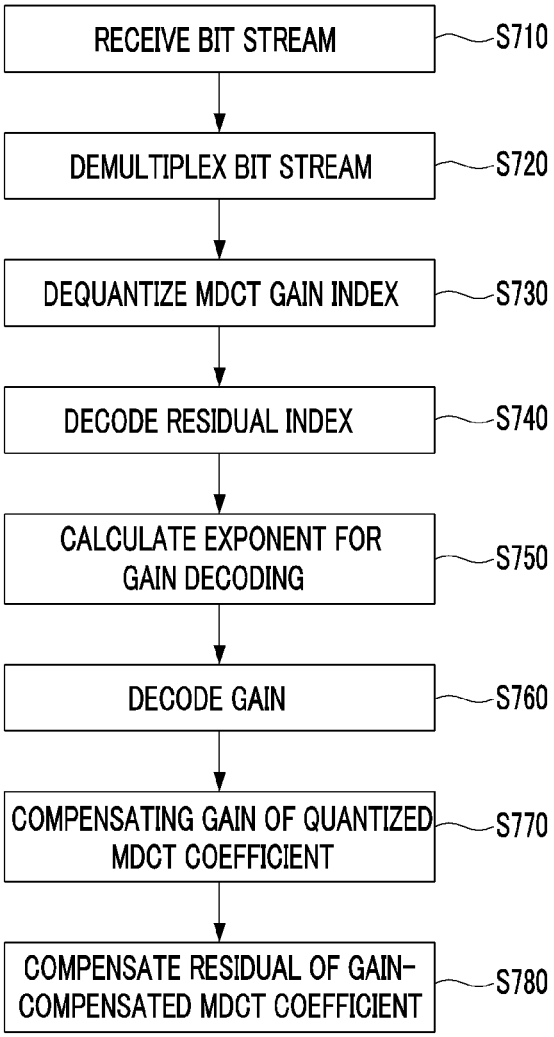
FIG. 7 is a flowchart of an MDCT enhancement layer decoding method according to an embodiment of the present invention.

FIG. 7 is a flowchart of an MDCT enhancement layer decoding method according to an embodiment of the present invention.

Referring FIG. 7, a decoder 420 receives a bit stream including MDCT indices, residual indices, and gain indices (S710), and demultiplexes the received bit stream into the MDCT indices, the gain indices, and the residual indices (S720). Then, the decoder 420 dequantizes the MDCT gain indices into the quantized MDCT coefficients (S730), and decodes the residual indices corresponding to sub-band indices $j_{max}$ to recover MDCT residual coefficients (S740). The decoder 420 calculates exponents using the position information of the recovered MDCT residual coefficients and the quantized MDCT coefficients (S750). The exponents may be calculated in the same way as the step S560 of FIG. 5. Next, the decoder 420 performs gain decoding based on the exponents to recover quantized gains, as described in the gain compensation decoder 125 of FIG. 2 (S760). That is, the decoder 420 generates a bit allocation table based on the exponents, and recovers the compensation gains for MDCT coefficients from the gain indices using the bit allocation table. As described above, the number of available bits corresponds to $B_{gc}$ in the gain decoding process. Since the exponent of the selected pulse positions is set to the minimum exponent value, the recovered gain of the selected pulse position can be set to a value that does not change the quantized MDCT coefficient, for example 1. Next, the decoder 420 compensates the quantized MDCT coefficients with the recovered gains (S770), and compensates the gain-compensated MDCT coefficients as Equation 9 to reconstruct the MDCT coefficients (S780). The gain-compensated MDCT coefficients and the reconstructed MDCT coefficients may be expressed as in Equation 21 and Equation 22, respectively.

$$\hat{X}_{gc}(k) = g_{I_{opt}(k)}{}^{m} \cdot \hat{X}(k),\ k = 0, 1, \ldots, (N-1) \quad \text{(Equation 21)}$$

where, $g_{I_{opt}(k)}{}^{m}$ represents a codeword in which i is $I_{opt}(k)$ in Equation 7.

$$\hat{X}_{gc}(k) = \hat{X}_{gc}(k) + \hat{E}(k) \quad \text{(Equation 22)}$$

Figure 8:
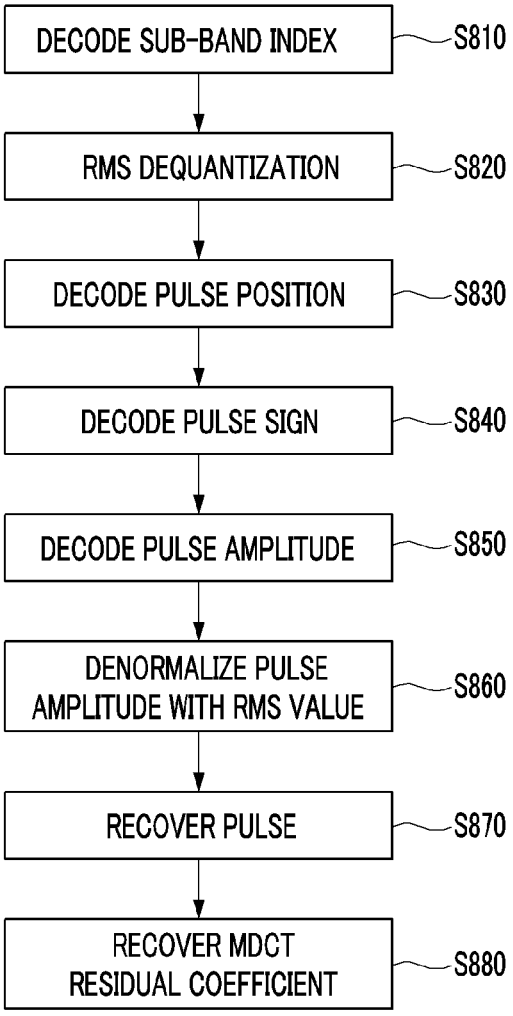
FIG. 8 is a flowchart showing an MDCT residual coefficients decoding process in an MDCT enhancement layer decoding method according to an embodiment of the present invention.

FIG. 8 is a flowchart showing an MDCT error decoding process in an MDCT decoding method according to an embodiment of the present invention.

Referring to FIG. 8, a decoder 420 decodes a sub-band index for error compensation (S810), and dequantize the RMS index to reconstruct a quantized RMS value (S820). The decoder 420 decodes position, sign, and amplitude components for pulses of the selected sub-band (S830, S840, and S850), and then denormalizes the decoded pulse amplitude with the quantized RMS value (S860). That is, the decoder 420 multiplies the decoded pulse amplitude by the quantized RMS value to produce denormalized pulse amplitudes. Next, the decoder 420 recovers the pulse using the decoded pulse sign and denormalized pulse amplitude (S870). The decoder 420 arranges the recovered pulses in accordance with a predetermined track structure using the decoded position of the recovered pulses, to recover quantized MDCT residual coefficients (S880). The recovered MDCT residual coefficients may be expressed as in Equation 23.

$$\hat{E}(k) = 0,\ k \neq p_i + l_{j_{max}},\ i = 0, 1, \ldots, (N_p - 1) \quad \text{(Equation 23)}$$

$$\hat{E}(p_i + l_{j_{max}}) = s_i \times \overline{\hat{m}}(i) \times \text{rms_}q,\ i = 0, 1, \ldots, (N_p - 1)$$

where, $s_i$ is the sign of the i-th pulse, and $\overline{\hat{m}}(i)$ is the RMS-normalized quantization pulse amplitude of the i-th pulse. For example, $p_i$ may be expressed as in Equation 24, and $s_i$ corresponds to s(t) of Equations 19 and 20 and may be expressed as in Equation 25.

$$p_i = 3I_{pos}(t) + t \quad \text{(Equation 24)}$$

$$s_i = 2(I_{sign}(t) - 0.5) \quad \text{(Equation 25)}$$

As such, according to the embodiment of the present invention, a combination of gain compensation scheme and residual compensation scheme can mitigate degradation of sound quality which may be resulted from a spectrum distortion caused by inconsistency between bit allocation in the gain compensation scheme and actual errors.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

The invention claimed is:

1. An encoding method of an encoder, the method comprising:

transforming an input signal to generate first modified discrete cosine transform (MDCT) coefficients;

quantizing the first MDCT coefficients to generate MDCT indices;

dequantizing the MDCT indices to generate second MDCT coefficients;

computing MDCT residual coefficients using differences between the first MDCT coefficients and the second MDCT coefficients;

encoding the MDCT residual coefficients to generate a residual index;

generating gain indices corresponding to gains from the first MDCT coefficients and the second MDCT coefficients; and multiplexing the MDCT indices, the residual index, and the gain indices by a multiplexer to generate a bit stream, wherein generating the residual index comprises selecting an index of a sub-band with a largest energy of MDCT residual coefficients among a plurality of sub-bands, and wherein encoding the MDCT residual coefficients comprises selecting a pulse at a position corresponding to a predetermined number of MDCT residual coefficients, and generating the gain indices comprises computing exponents that are logarithms of magnitudes of the second MDCT coefficients at positions excluding the position of the pulse.

2. The method of claim 1, wherein generating the residual index further comprises:

generating a sub-band index by encoding the selected index, wherein the residual index includes the sub-band index.

3. The method of claim 2, wherein the energy of the MDCT residual coefficient of a j-th sub-band is computed as $$\sum_{k=l_j}^{u_j} \{E(k)\}^2,$$

wherein $u_j$ and lj are a lower boundary index and an upper boundary index of the j-th sub-band, respectively, and E(k) is a k-th MDCT residual coefficient.

4. The method of claim 2, wherein generating the residual index further comprises encoding MDCT residual coefficients of the selected sub-band.

5. The method of claim 4, wherein encoding the MDCT residual coefficients further comprises:

configuring a plurality of tracks for MDCT residual coefficients of the selected sub-band;

selecting the pulse corresponding to the predetermined number of MDCT residual coefficients having a largest absolute value, among MDCT residual coefficients corresponding to possible positions in each track; and coding the pulse, wherein the residual index further includes a coded value of the pulse.

6. The method of claim 5, wherein coding the pulse comprises:

coding a position of the pulse;

coding the sign of the pulse; and coding the amplitude of the pulse, wherein the coded value of the pulse includes a coded value of the position, a coded value of the sign, and a coded value of the amplitude.

7. The method of claim 6, wherein the position is a position that is relative to a lower boundary index of the selected sub-band.

8. The method of claim 6, wherein encoding the MDCT residual coefficients comprises:

computing a root mean square (RMS) value of the MDCT residual coefficients of the selected sub-band; and quantizing the RMS value to generate an RMS index, wherein the residual index further includes the RMS index.

9. The method of claim 8, wherein coding the amplitude of the pulse comprises:

quantizing the RMS index to generate a quantized RMS value; and coding the amplitude of the pulse using the amplitude of the pulse divided by the quantized RMS value.

10. The method of claim 5, wherein generating the gain indices further comprises:

setting an exponent to a minimum exponent magnitude at the position of the pulse; and allocating bits for the gain indices based on the exponents.

11. The method of claim 10, wherein generating the gain indices further comprises determining the gain indices from the allocated bits, the first MDCT coefficients, and the second MDCT coefficients.

12. The method of claim 11, wherein the gain index is determined as i for maximizing $-2\cdot g_i^m\cdot X(k)\cdot\hat{X}(k)+(g_i^m)^2\cdot(\hat{X}(k))$, wherein $g_i^m$ is an i-th codeword of a codebook corresponding to m bits, i is an integer within a range of 0 to $(2^m-1)$, X(k) is a k-th first MDCT residual coefficient, and $\hat{X}(k)$ is a k-th second MDCT residual coefficient.

13. A decoding method of a decoder, the method comprising:

demultiplexing a received bit stream by a demultiplexer to receive MDCT indices, a residual index, and gain indices;

dequantizing the MDCT indices to generate first MDCT coefficients;

decoding the residual index to recover MDCT residual coefficients;

recovering gains from the gain indices using a position of a pulse at a position corresponding to the MDCT residual coefficients and the first MDCT coefficients;

compensating gains of the first MDCT coefficients with the recovered gains generating second MDCT coefficients; and compensating residuals of the second MDCT coefficients with the MDCT residual coefficients, wherein recovering the gains comprises computing exponents that are logarithms of magnitudes of the first MDCT coefficients at positions excluding the position of the pulse.

14. The method of claim 13, wherein compensating the residuals comprises adding the MDCT residual coefficients to the second MDCT coefficients.

15. The method of claim 14, wherein the MDCT residual coefficients has a value of 0 at positions excluding the position of the pulse.

16. The method of claim 13, wherein the residual index includes a sub-band index, and recovering the MDCT residual coefficients comprises determining a sub-band of the MDCT residual coefficients by decoding the sub-band index.

17. The method of claim 13, wherein the residual index includes a coded value of the position of the pulse, a coded value of the sign of the pulse, and a coded value of the amplitude of the pulse.

18. The method of claim 17, wherein recovering the MDCT residual coefficients comprises:

decoding the coded value of the amplitude of the pulse to reconstruct the amplitude of the pulse by;

decoding the coded value of the position of the pulse to reconstruct the position of the pulse;

decoding the coded value of the sign of the pulse to reconstruct the sign of the pulse; and recovering the MDCT residual coefficients based on the position, sign, and amplitude of the pulse.

19. The method of claim 18, wherein the residual index further includes a root mean square (RMS) index, wherein recovering the amplitude of the pulse comprises:

generating a quantized RMS value from the RMS index; and multiplying the decoded amplitude of the pulse by the quantized RMS value to recover the amplitude of the pulse.

20. The method of claim 13, wherein recovering the gains further comprises:

setting an exponent to a minimum exponent magnitude at the position of the pulse; and generating a bit allocation table by allocating bits to the gain indices based on the exponents.

21. The method of claim 20, wherein recovering the gains further comprises recovering the gains from the gain indices using the bit allocation table.

22. The method of claim 13, further comprising recovering a signal by transforming MDCT coefficients, which are generated by compensating the residuals of the second MDCT coefficients, by an inverse MDCT.

23. An encoding apparatus, comprising:

an MDCT configured to transform an input signal to generate first MDCT coefficients;

an MDCT quantizer configured to quantize the first MDCT coefficients to generate MDCT indices;

an enhancement layer encoder configured to dequantize the MDCT indices to generate second MDCT coefficients, to encode MDCT residual coefficients corresponding to differences between the first MDCT coefficients and the second MDCT coefficients to generate a residual index, and to generate gain indices corresponding to gains of the first MDCT coefficients from the first MDCT coefficients and the second MDCT coefficients; and a multiplexer configured to multiplex the MDCT indices, the residual index, and the gain indices to generate a bit stream, wherein the enhancement layer encoder comprises a residual compensation encoder configured to select an index of a sub-band having a largest energy of MDCT residual coefficients among a plurality of sub-bands, and wherein the residual compensation encoder selects a pulse at a position corresponding to a predetermined number of MDCT residual coefficients, and the enhancement layer encoder generates exponents that are logarithms of magnitudes of the second MDCT coefficients at positions excluding the position of the pulse.

24. The apparatus of claim 23, wherein the residual compensation encoder is further configured to generate a sub-band index by encoding the selected index, and wherein the residual index includes the sub-band index.

25. The apparatus of claim 24, wherein the residual compensation encoder configures a plurality of tracks for MDCT residual coefficients of the selected sub-band, and codes the position, the sign, and the amplitude of the pulse corresponding to the predetermined number of MDCT residual coefficients having the largest absolute value among MDCT residual coefficients corresponding to possible positions in each track, wherein the residual index further includes a coded value of the position, a coded value of the sign, and a coded value of the amplitude.

26. The apparatus of claim 25, wherein the residual compensation encoder quantize a root mean square (RMS) value of the MDCT residual coefficients of the selected sub-band to generate an RMS index by, wherein the residual index further includes the RMS index.

27. The apparatus of claim 25, wherein the enhancement layer encoder sets an exponent to a minimum exponent magnitude at the position of the pulse, and allocates bits for the gain indices based on the exponents.

28. The apparatus of claim 27, wherein the gain compensation encoder determines the gain index as i for maximizing $-2\cdot g_i^m\cdot X(k)\cdot\hat{X}(k)+(g_i^m)^2\cdot(\hat{X}(k))$, wherein $g_i^m$ is the i-th codeword of a codebook corresponding to m bits, i is an integer within a range of 0 to $(2^m-1)$, $X(k)$ is the k-th first MDCT residual coefficient, and $\hat{X}(k)$ is the k-th second MDCT residual coefficient.

29. A decoding apparatus, comprising:

a demultiplexer configured to demultiplex a received bit stream to output MDCT indices, a residual index, and gain indices;

an MDCT dequantizer configured to dequantize the MDCT indices to generate first MDCT coefficients; and an enhancement layer decoder configured to decode the residual index, recover gains from the gain indices using a position of a pulse at a position corresponding to the MDCT residual coefficients and the first MDCT coefficients to recover MDCT residual coefficients, compensate gains of the first MDCT coefficients with the recovered gains to generate second MDCT coefficients, and compensate residuals of the second MDCT coefficients with the MDCT residual coefficients, wherein the enhancement layer decoder comprises a gain compensation decoder configured to compute exponents that are logarithms of magnitudes of the first MDCT coefficients at positions excluding the position of the pulse.

30. The apparatus of claim 29, wherein the enhancement layer decoder comprises a residual compensator configured to add the MDCT residual coefficients to the second MDCT coefficients to compensate the residuals of the second MDCT coefficients.

31. The apparatus of claim 29, wherein the residual index includes a coded value of the position of the pulse, a coded value of the sign of the pulse, and a coded value of the amplitude of the pulse, wherein the enhancement layer decoder comprises a residual compensation decoder configured to decode the coded values of the position, sign, and amplitude of the pulse to recover the position, sign, and amplitude of the pulse.

32. The apparatus of claim 31, wherein the residual index further includes a root mean square (RMS) index, wherein the residual compensation decoder generates a quantized RMS value from the RMS index, and multiplies the decoded amplitude of the pulse by the quantized RMS value to recover the amplitude of the pulse.

33. The apparatus of claim 29, wherein the gain compensation decoder is further configured to generate a bit allocation table by allocating bits to the gain indices based on the exponents, and recover the gains using the gain indices and the bit allocation table.

34. The apparatus of claim 29, further comprising an inverse MDCT configured to recover a signal by transforming MDCT coefficients in which the residuals are compensated, by the inverse MDCT.

* * * * *